US006879798B2

(12) United States Patent
Aoki

(10) Patent No.: US 6,879,798 B2
(45) Date of Patent: Apr. 12, 2005

(54) IMAGE FORMING APPARATUS

(75) Inventor: Masamichi Aoki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/634,517

(22) Filed: Aug. 4, 2003

(65) Prior Publication Data

US 2004/0151523 A1 Aug. 5, 2004

(30) Foreign Application Priority Data

Feb. 5, 2003 (JP) ..... 2003-027864

(51) Int. Cl.[7] ..... G03G 15/08
(52) U.S. Cl. ..... 399/252; 399/350; 430/105
(58) Field of Search ..... 399/222, 252, 399/350; 430/110.1, 110.3, 105

(56) References Cited

U.S. PATENT DOCUMENTS 6,137,977 A * 10/2000 Okado et al. ..... 399/252
2003/0152857 A1 * 8/2003 Sugiura et al.

FOREIGN PATENT DOCUMENTS

JP 11295922 A * 10/1999 ..... G03G/9/08
JP 11295924 A * 10/1999 ..... G03G/9/08
JP 2002023499 A * 1/2002 ..... G03G/15/09

* cited by examiner

*Primary Examiner*—Susan Lee
(74) *Attorney, Agent, or Firm*—Akin Gump Strauss Hauer & Feld, LLP

(57) ABSTRACT

An image forming apparatus includes an image bearing body, a developing unit, and a transfer unit. The image bearing body bears an electrostatic latent image formed thereon. The developing unit supplies a developer material to the image bearing body to develop the electrostatic latent image into a visible image. The transfer unit transfers the visible image onto a print medium. The developer-removing blade has a longitudinally extending edge in contact with the image bearing body with a line pressure in the range of 3 to 8 gf/mm, the edge removing an amount of residual developer material on the image bearing body. The developer material has substantially spherical particles and has compressibility in the range of 30 to 55. The compressibility is given by A={(D1−D2)/D1}×100%, where D1 is aerated bulk density and D2 is packed bulk density.

4 Claims, 5 Drawing Sheets

| | FIRST TONER | SECOND TONER | THIRD TONER | FOURTH TONER | FIFTH TONER | SIXTH TONER |
|---|---|---|---|---|---|---|
| COMPRESSIBILITY | 55 | 50 | 45 | 40 | 35 | 30 |
| SLIPPING - THROUGH OF TONER | ○ | ○ | ○ | ○ | ○ | × |

FIG.4

| RESILIENCE | COMPRESSIBILITY | | | | |
|---|---|---|---|---|---|
| | 55 | 50 | 45 | 40 | 35 |
| 50 | × | × | × | × | × |
| 40 | × | × | × | × | × |
| 35 | × | × | × | × | × |
| 30 | × | × | × | × | × |
| 25 | × | × | × | × | × |
| 20 | × | × | × | × | × |
| 15 | × | × | × | × | × |
| 10 | × | × | × | × | × |
| 5 | × | × | × | × | × |

FIG.5

| RESILIENCE | COMPRESSIBILITY | | | | |
|---|---|---|---|---|---|
| | 55 | 50 | 45 | 40 | 35 |
| 50 | × | × | × | × | × |
| 40 | ○ | ○ | ○ | ○ | ○ |
| 35 | ◎ | ◎ | ◎ | ◎ | ◎ |
| 30 | ◎ | ◎ | ◎ | ◎ | ◎ |
| 25 | ◎ | ◎ | ◎ | ◎ | ◎ |
| 20 | ◎ | ◎ | ◎ | ◎ | ◎ |
| 15 | ○ | ○ | ○ | ○ | ○ |
| 10 | × | × | × | × | × |
| 5 | × | × | × | × | × |

FIG.6

| RESILIENCE | COMPRESSIBILITY | | | | |
|---|---|---|---|---|---|
| | 55 | 50 | 45 | 40 | 35 |
| 50 | × | × | × | × | × |
| 40 | ○ | ○ | ○ | ○ | ○ |
| 35 | ◎ | ◎ | ◎ | ◎ | ◎ |
| 30 | ◎ | ◎ | ◎ | ◎ | ◎ |
| 25 | ◎ | ◎ | ◎ | ◎ | ◎ |
| 20 | ◎ | ◎ | ◎ | ◎ | ◎ |
| 15 | ○ | ○ | ○ | ○ | ○ |
| 10 | × | × | × | × | × |
| 5 | × | × | × | × | × |

FIG.7

| RESILIENCE | COMPRESSIBILITY | | | | |
|---|---|---|---|---|---|
| | 55 | 50 | 45 | 40 | 35 |
| 50 | × | × | × | × | × |
| 40 | ○ | ○ | ○ | ○ | ○ |
| 35 | ◎ | ◎ | ◎ | ◎ | ◎ |
| 30 | ◎ | ◎ | ◎ | ◎ | ◎ |
| 25 | ◎ | ◎ | ◎ | ◎ | ◎ |
| 20 | ◎ | ◎ | ◎ | ◎ | ◎ |
| 15 | ○ | ○ | ○ | ○ | ○ |
| 10 | × | × | × | × | × |
| 5 | × | × | × | × | × |

FIG.8

| RESILIENCE | COMPRESSIBILITY | | | | |
|---|---|---|---|---|---|
| | 55 | 50 | 45 | 40 | 35 |
| 50 | × | × | × | × | × |
| 40 | × | × | × | × | × |
| 35 | × | × | × | × | × |
| 30 | × | × | × | × | × |
| 25 | × | × | × | × | × |
| 20 | × | × | × | × | × |
| 15 | × | × | × | × | × |
| 10 | × | × | × | × | × |
| 5 | × | × | × | × | × |

IMAGE FORMING APPARATUS

FIELD OF THE INVENTION

The present invention generally relates to an image forming apparatus.

DESCRIPTION OF THE RELATED ART

Conventional electrophotographic image forming apparatus such as printers, copying machines, and facsimile machines employ electrophotographic processes. An electrostatic latent image is formed on an image bearing body made of a photoconductive material or a dielectric material. The electrostatic latent image is then developed with a developer (toner) into a toner image. The toner image is then transferred onto a print medium, e.g., print paper. When the toner image is transferred onto the print medium, a small amount of toner fails to be transferred and remains on the image bearing body. Because residual toner on the image bearing body causes poor image quality, the residual toner is usually removed by, for example, a cleaning blade from the image bearing body.

In recent years, there have been demands towards high quality images and toner having particles in the shape of a sphere or the like has been employed in order to meet such demands. However, the spherical toner particles are easy to slip through gaps between a cleaning blade and the surface of an image bearing body, increasing the chance of cleaning failure occurring.

In order to prevent cleaning failure resulting from the use of toner having substantially spherical particles, a technique has been proposed in which irregularly shaped toner particles are applied to the surface of the cleaning blade. However, the irregularly shaped toner particles will come off the developing blade little by little over time, gradually losing the ability to prevent cleaning failure.

SUMMARY OF THE INVENTION

The present invention was made to solve the aforementioned drawbacks of the conventional art.

An object of the present invention is to provide an image forming apparatus that reliably prevents cleaning failure and poor image quality even when toner having substantially spherical particles is used.

An image forming apparatus includes an image bearing body, a developing unit, and a transfer unit. The image bearing body bears an electrostatic latent image formed thereon. The developing unit supplies a developer material to the image bearing body to develop the electrostatic latent image into a visible image. The transfer unit transfers the visible image onto a print medium. The developer-removing blade has a longitudinally extending edge in contact with the image bearing body with a line pressure in the range of 3 to 8 gf/mm. The edge removes an amount of residual developer material on the image bearing body. The developer material has substantially spherical particles and has a compressibility given by $A=\{(D1-D2)/D1\}\times 100$, where D1 is an aerated bulk density or bulk density before the developer material is compressed, and D2 is a packed bulk density or bulk density a predetermined time after the developer material begins to be compressed.

The developer-removing blade has a longitudinally extending edge in contact with the image bearing body.

The developer-removing blade has a resilience in the range of 15 to 40% and is in contact with a line pressure in the range of 3 to 8 gf/mm.

The developer-removing blade has resilience in the range of 20 to 35% and is in contact with a line pressure in the range of 3 to 8 gf/mm.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIGS. 4–8 illustrate the evaluation of cleaning effect according to a second embodiment.

DETAILED DESCRIPTION OF THE INVENTION

Embodiments of the invention will be described in detail with reference to the accompanying drawings.

First Embodiment

{Construction}

Figure 1:
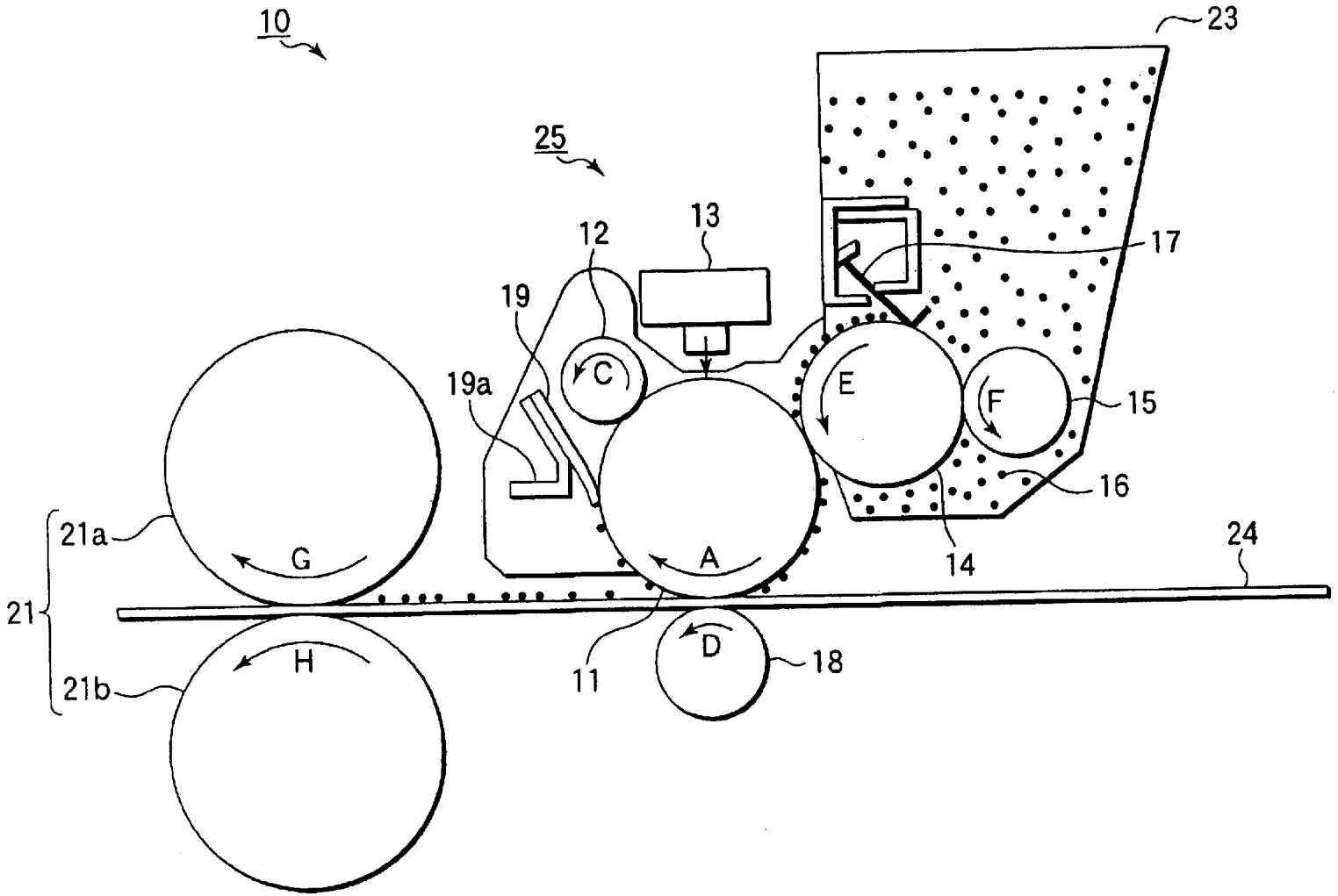
FIG. 1 illustrates the configuration of a pertinent portion of an image forming apparatus according to a first embodiment.

FIG. 1 illustrates the configuration of a pertinent portion of an image forming apparatus according to a first embodiment.

Referring to FIG. 1, an image forming apparatus 10 includes an image forming section 25 and a fixing unit 21. The image forming apparatus 10 is, for example, a printer, a facsimile machine, or a copying machine in which a black-and-white image or a color image is formed on a print medium such as print paper, envelope, and transparency. The image forming section 25 forms a toner image on recording paper 24 and the fixing unit 21 fuses the toner image carried on the recording paper 24. The image forming section 25 forms either a black-and-white image or a color image. If the image forming apparatus 10 is used for printing a color image, then four image forming sections 25, i.e., image forming sections for yellow, magenta, cyan, and black images are aligned along a transport path of the recording paper 24.

The image forming apparatus 10 further includes a paper cassette, a recording medium transporting mechanism, a motor, not shown, a drive unit, and a controller. The paper cassette holds a stack of the recording paper 24. The motor drives movable parts such as rollers used in the image forming section 25, fixing unit 21 and the recording medium transporting mechanism. The controller includes an operation panel and a communication interface, not shown, to control the operation of the image forming apparatus 10.

The image forming section 25 includes a photoconductive drum 11, a charging roller 12, an exposing unit 13, and a developing unit 23. The photoconductive drum 11 serves as an image bearing body. The charging roller 12 charges the surface of the photoconductive drum 11. The exposing unit 13 has an LED array (light emitting diode array) that illuminates the charged surface of the photoconductive drum 11 to form an electrostatic latent image on the surface. The developing unit 23 supplies toner 16 to the electrostatic latent image, thereby developing the electrostatic latent image into a toner image.

The drive unit drives the photoconductive drum 11 in rotation, the photoconductive drum 11 rotating in a direction shown by arrow A at a predetermined speed. The photoconductive drum 11 includes a drum-shaped electrically conductive support made of, for example, metal, and a photoconductive material formed on the support. The photoconductive body according to the invention is an organic photoconductive material such as selenium photoconductor, zinc oxide photoconductor, and amorphous silicone photoconductor. The exposing unit 13 takes the form of an LED head, which is a combination of LED arrays and a SELFOC LENS (trade name) array. Alternatively, the exposing unit 13 may be a laser exposing unit, which is a combination of a laser light source and an image forming optical system such as a lens. The charging roller 12 includes a metal shaft and an electrically semiconductive rubber layer formed around the metal shaft.

The developing unit 23 holds the toner 16 therein and includes a developing roller 14, a toner supplying roller 15, and a developing blade 17. The developing roller 14 supplies the toner 16 to the surface of the photoconductive drum 11 to develop the electrostatic latent image on the surface of the photoconductive drum 11. The toner supplying roller 15 supplies the toner 16 to the developing roller 14. The developing blade 17 restricts the thickness of the layer of toner on the developing roller 14. The developing roller 14 and toner supplying roller 15 are driven by the drive unit, so that the rollers 14 and 15 rotate in directions shown by arrows E and F, respectively. The toner 16 has substantially spherical particles.

The image forming apparatus 10 further includes a transfer roller 18 and a cleaning blade 19. The transfer roller 18 transfers the toner image from the photoconductive drum 11 onto the recording paper 24. The cleaning blade 19 removes residual toner, which failed to be transferred and remained on the photoconductive drum 11. The cleaning blade 19 is mounted in the developing unit 23 by means of a blade-supporting member 19*a*.

Alternatively, the image forming apparatus 10 may have a transfer belt, not shown, in which case the toner image on the photoconductive drum 11 is transferred onto the transfer belt and then transferred from the transfer belt onto the recording paper 24. In this configuration, the cleaning blade 19 is disposed to remove the residual toner from the transfer belt. The present invention will be described with respect to a case where no transfer belt is employed.

The fixing unit 21 includes a heat roller 21*a* and a pressure roller 21*b* in pressure contact with the heat roller 21*a*. The recording paper 24 is pulled in between the heat roller 21*a* and the pressure roller 21*b*, so that the toner image on the recording paper 24 is fused into a permanent image.

{Printing Operation}

The operation of the image forming apparatus of the aforementioned configuration will be described. The image forming process will first be described.

The drive unit drives the photoconductive drum 11 so that the photoconductive drum 11 rotates at a predetermined speed in the direction shown by arrow A. The drive unit also drives the charging roller 12, developing roller 14, and toner supplying roller 15 so that the rollers 12, 14, and 15 rotate in the directions shown by arrows C, E, and F, respectively. The charging roller 12 is disposed to be either in contact with the photoconductive drum 11 or in pressure contact with the photoconductive drum 11. The charging roller 12 receives a high voltage from a high voltage power supply and charges the surface of the photoconductive drum 11 uniformly. As the photoconductive drum 11 rotates, the charged surface reaches the exposing unit 13 where the exposing unit 13 illuminates the charged surface of the photoconductive drum 11 in accordance with an image signal to form an electrostatic latent image on the photoconductive drum 11.

The photoconductive drum 11 rotates further so that the electrostatic latent image on the photoconductive drum 11 reaches the developing roller 14. The developing roller 14 supplies the toner 16 to the electrostatic latent image to develop the electrostatic latent image into a toner image. The toner supplying roller 15 receives a high voltage from a high voltage power supply and rotates to supply the toner 16 held in the developing unit 23 to the developing roller 14. The developing blade 17 is in pressure contact with the developing roller 14 to form a thin layer of toner 16 on the developing roller 14, the layer of toner having a uniform thickness and being attracted to the developing roller 14.

The image forming apparatus according to the present embodiment performs reversal development. A high-voltage power supply, not shown, applies a high bias voltage across the electrically conductive support of the photoconductive drum 11 and the developing roller 14. The high bias voltage creates an electric field between the developing roller 14 and the electrostatic latent image on the photoconductive drum 11, so that the charged toner 16 migrates from the developing roller 14 to the electrostatic latent image by the Coulomb force to form a toner image.

A feed roller, not shown, feeds the recording paper 24 held in the paper cassette, not shown, to the transport rollers, which in turn temporarily stop to minimize the skew of the recording paper 24. Then, the transport rollers start to rotate to advance the recording paper 24 to the transfer point of the image forming section 25, defined between the photoconductive drum 11 and the transfer roller 18. The transfer roller 18 opposes the photoconductive drum 11 and receives a high-voltage from a high-voltage power supply, and is rotated by a drive unit, not shown, in a direction shown by arrow D.

Subsequently, the recording paper 24 is advanced to the fixing unit 21 and pulled in between the heat roller 21*a* and the pressure roller 21*b* that rotate in the directions shown by arrows G and H, respectively. The heat roller 21*a* heats the toner 16 on the recording paper 24 to fuse the toner 16 into the recording paper 24. The recording paper 24 is then discharged from the image forming apparatus 10.

Some toner may remain as residual toner on the photoconductive drum 11 after transfer. The residual toner is removed from photoconductive drum 11 by the cleaning blade 19. The cleaning blade 19 extends along the axial length of the photoconductive drum 11 and urges the photoconductive drum 11 under a line pressure of 5 gf/mm. The cleaning blade 19 according to the embodiment is made of a resilient rubber material such as urethane elastomer having resilience at 20° C. However, the cleaning blade may be made of any rubber material.

The aforementioned operation is repeatedly performed during the image forming process.

{Cleaning Operation}

The cleaning operation of the cleaning blade will be described.

Figures 2, 3:
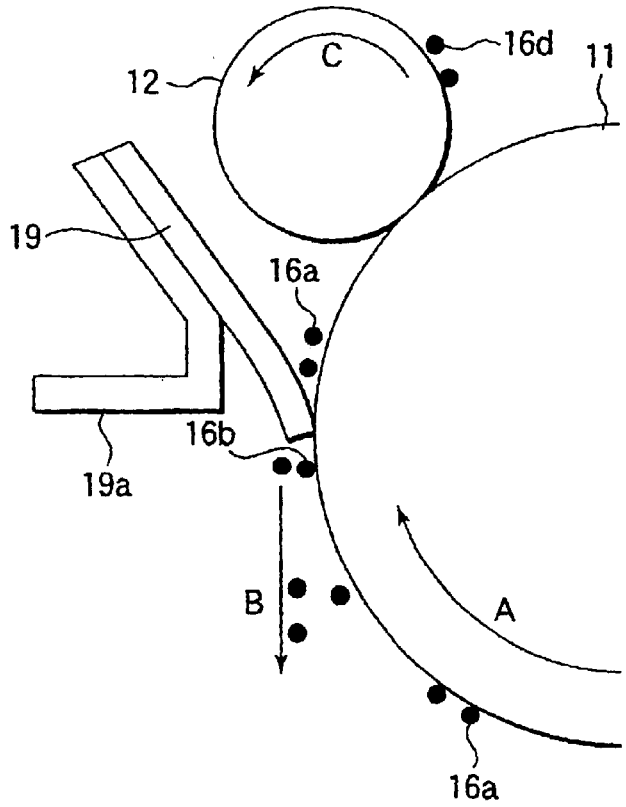
FIG. 2 illustrates the operation of the cleaning blade according to the first embodiment.
FIG. 3 illustrates the evaluation of the slipping of aerated toner particle through the gap between the cleaning blade 19 and the photoconductive drum in the first embodiment.

FIG. 2 illustrates the operation of the cleaning blade according to the first embodiment.

The residual toner is delivered to the cleaning blade 19 as the photoconductive drum 11 continues to rotate in the direction shown by arrow A after transfer. The residual toner is scraped by a longitudinally extending edge of the cleaning blade 19 off the surface of the photoconductive drum 11 and falls in a direction shown by arrow B into a waste toner reservoir, not shown, due to its weight.

The toner may clump at the edge of the cleaning blade 19 and flip through the gaps between the cleaning blade 19 and the photoconductive drum 11. Then, the toner may further be delivered downstream with respect to the rotation of the photoconductive drum 11. The residual toner is then deposited as contamination toner 16*d* on the charging roller 12. Therefore, the embodiment employs toner having predetermined properties in order to prevent contamination toner 16*d* from occurring.

Experiments were performed for different types of toners. First, the manufacturing of the different types of toners will be described.

A mixture of the following materials was introduced into an attritor (MA-01SC from Mitsui-Miike Koki): 80 parts by weight of styrene, 20 parts by weight of acrylic acid-n-butyl, 4 parts by weight of low molecular weight polyethylene, 1 weight part by weight of charge control agent (AIZEN SPILON BLACK THR), 7 parts by weight of carbon black, 1 weight part by weight of t-dodecyl mercaptan, and 1 part by weight of 2,2'-azobisisobutyronitrile. Then, the mixture was dispersed at 15° C. for 10 hours, thereby obtaining a polymerized composition.

Eight parts by weight of polyacrylic acid and 0.35 parts by weight of divinylbenzene were dissolved in 180 parts by weight of ethanol. A dispersion medium was prepared by adding 600 parts by weight of distilled water to the thus obtained ethanol. The polymerized composition was added to the dispersion medium and was dispersed with a TK homomixer (Model M, from Tokushu Kogyo) at 15° C. at 8000 rpm for 10 minutes, thereby obtaining a dispersion liquid. The thus obtained dispersion liquid was introduced in a separable flask of 1-liter capacity and agitated in a flow of nitrogen at 85° C. at 100 rpm for 12 hours for polymerization reaction, thereby obtaining a dispersoid, which is called intermediate particles in this specification.

Using a ultrasonic generator (US-150 from Nippon Seiki Seisakusho), emulsion A was prepared which is made of 9.25 parts by weight of methyl methacrylate, 0.75 parts by weight of acrylic acid-n-butyl, 0.5 parts by weight of azobisisobutyronitrile, 0.1 parts by weight of sodium lauryl sulphate, and 80 parts by weight of water. Then, 9 parts by weight of the emulsion A was dripped into aqueous suspension of the intermediate particles, so that the intermediate particles were swelled. The aqueous suspension of the intermediate particles was observed under an optical microscope immediately after the emulsion A was dripped into the aqueous suspension of the intermediate particles. No drip of emulsion was observed and the swelling appeared to have completed in a short time.

Subsequently, a second stage of polymerization was performed where the intermediate particles were subjected to reaction at 5° C. for 10 hours, while being agitated in a nitrogen atmosphere. Then, after the material was cooled, the residual dispersion medium was dissolved in a 0.5N aqueous solution of hydrochloric acid, and then filtered and washed with water. Then, the material was air-dried. The material was then dried under reduced pressure for 10 hours at 40° C. under a low pressure of 10 mm Hg. The material was classified with a pneumatic separator, thereby obtaining toner particles having an average diameter of 7 $\mu$m and a roundness of 0.97 given by Equation (1).

$$\text{Roundness}=L1/L2. \quad (1)$$

where L1 is a circumference of a circle having the same area as the projection of a particle and L2 is a circumference of the projection.

The toner can be of any type manufactured by any methods, provided that toner particles are substantially spherical and have a roundness of 0.97 or greater. For example, the toner may be manufactured by chemical polymerization such as emulsion polymerization and suspension polymerization. Alternatively, the spherical toner may be manufactured by subjecting the material to heat treatment to ensphere the material.

The following first to sixth toners have an external additive so that the particles have various bulk densities.

(1) The following materials were added to the aforementioned toner particles: 0.5 parts by weight of silica having an average diameter of 12 nm, 2.0 parts by weight of silica having an average diameter of 40 nm, and 2.0 parts by weight of alumina having an average diameter of 100 nm. The resultant toner is referred to as a first toner in this specification.

(2) The following materials were added to the aforementioned toner particles: 0.5 parts by weight of silica having an average diameter of 12 nm, 2.0 parts by weight of silica having an average diameter of 40 nm, and 1.5 parts by weight of alumina having an average diameter of 100 nm. The resultant toner is referred to as a second toner in this specification.

(3) The following materials were added to the aforementioned toner particles: 0.5 parts by weight of silica having an average diameter of 12 nm, 2.0 parts by weight of silica having an average diameter of 40 nm, and 1.0 parts by weight of alumina having an average diameter of 100 nm. The resultant toner is referred to as a third toner in this specification.

(4) The following materials were added to the aforementioned toner particles: 0.5 parts by weight of silica having an average diameter of 12 nm, 2.0 parts by weight of silica having an average diameter of 40 nm, and 0.5 parts by weight of alumina having an average diameter of 100 nm. The resultant toner is referred to as a fourth toner in this specification.

(5) The following materials were added to the aforementioned toner particles: 0.5 parts by weight of silica having an average diameter of 12 nm, 2.0 parts by weight of silica having an average diameter of 40 nm, and 0.3 parts by weight of alumina having an average diameter of 100 nm. The resultant toner is referred to as a fifth toner in this specification.

(6) The following materials were added to the aforementioned toner particles: 0.5 parts by weight of silica having an average diameter of 12 nm, 2.0 parts by weight of silica having an average diameter of 40 nm, and 0.1 parts by weight of alumina having an average diameter of 100 nm. The resultant toner is referred to as a sixth toner in this specification.

The term "toner 16" is used to cover the aforementioned first to sixth toners hereinafter.

A description will now be given of the measurement of the bulk density of the first to sixth toners and the evaluation of flipping through of toner particles having an aerated bulk density.

A portion of the toner particles clumped at the edge of the cleaning blade 19 flips through the gaps between the cleaning blade and the photoconductive drum 11 and is delivered as the contamination toner 16*d* to sections downstream with respect to the rotation of the photoconductive drum 11. One reason for this is that the toner particles at the edge of the cleaning blade 19 are substantially spherical, and therefore can be clumped in a most dense structure in which the toner particles are packed without gaps therebetween. The particles of the toner 16 gathered at the edge of the cleaning blade 19 are substantially spherical and therefore they have large surface areas in contact with one another and are almost the same size. Thus, the toner particles may be, considered to be difficult to move one over the other. The particles have large surface areas in contact with the surface of the photoconductive drum 11 and therefore adhere to the surface strongly. Thus, the toner particles gathered at the edge of the cleaning blade behave as if a single body and pushes up the edge of the cleaning blade to flip through the gap between the cleaning blade and the photoconductive drum 11.

The inventor found some sort of measurement indicative of how easily the particles of the toner 16 form a most packed structure. The measurement is the difference between aerated bulk density and packed bulk density of the toner 16. Aerated bulk density is one when a sufficient amount of air enters among the particles of toner 16. Packed bulk density is one when the particles of toner 16 held in a container are subjected to tapping so that there is less air among the toner particles as compared to the aerated toner particles. The difference between aerated bulk density and packed bulk density is referred to as compressibility. The compressibility of toner is given by Equation (2).

$$A=\{(D2-D1)/D1\}\times 100 \quad (2)$$

where A is compressibility, D1 is aerated bulk density, i.e., bulk density before the toner begins to be packed, and D2 is packed bulk density, i.e., bulk density a predetermined time after the toner begins to be packed.

The bulk density of the first to sixth toners was measured with a multi tester MT-100, available from Seishin Kigyo as follows:

A net having a mesh of 250 $\mu$m was placed on the funnel of the multi tester MT-100. The toner 16 was placed thereon. The net was then subjected to vibration at a feeder level 5.5 (amplitude of vibration: 0.5 mm), so that the toner particles fall through the mesh into a cylindrical container with a maximum graduation of 100 cc. Then, the toner was "cut" by rubbing with a slide plate and then bulk density was measured as an aerated bulk density D1.

Then, the funnel that holds the toner 16 therein was plugged and subjected to tapping with a tapping distance of 18 mm. When the rate of change in volume of the toner 16 in the container reached less than 0.1%, the bulk density was measured as a packed bulk density D2. With these values of D1 and D2, the compressibility was calculated using Equation (2).

Then, evaluation was conducted of the easiness for the toner having an aerated bulk density to flip through the gaps between the cleaning blade 19 and the photoconductive drum 11. A toner having a compressibility higher than 55 presents a problem in forming a toner layer on the developing roller 14, and therefore results in poor image quality such as drops of dots. This loses advantages of using a toner having substantially spherical particles. Thus, toners having a compressibility of 55 or less were tested actually.

A voltage was applied to the transfer roller 18 such that residual toner 16*a* of about 0.4 mg/cm$^2$ remains on the photoconductive drum 11. Then, printing operations were performed on 100 pages of the recording paper 24 using the first to sixth toners. It can be considered that a toner is extremely unreliable for continuous use if the toner can flip through the gaps between the cleaning blade 19 and the photoconductive drum 11 at this initial stage.

FIG. 3 illustrates the evaluation of the flipping of toner, which has an aerated bulk density, through the gap between the cleaning blade 19 and the photoconductive drum 11. The symbol "○" denotes that the toner particles do not flip through the gaps between the cleaning blade and the photoconductive drum, while the symbol "X" denotes that the toner particles flip through the gap.

If the toner particles flip through the gaps, the toner particles are deposited as a contamination toner 16*d* on the charging roller 12. Thus, the flipping through of toner was determined depending on whether the charging roller 12 is contaminated by the contamination toner 16*d*.

Generally, flipping through of toner is considered due to the fact that because toner particles gathered at the edge of a cleaning blade have large surface areas in contact with one another and are almost the same size, the toner particles are difficult to climb one over the other. Such toner particles are easy to form a most packed structure, which in turn pushes up the edge of the cleaning blade.

For printing of first 100 pages, the smaller the value of compressibility is, the more easily the particles form a most packed structure, so that the toner particles gathered at the edge of the cleaning blade tend to clump. As a result, the toner particles slip through the gaps between the cleaning blade 19 and the photoconductive drum 11. In contrast, toners having larger compressibility are difficult to form a most packed structure and accordingly cannot slip through the gaps between the cleaning blade 19 and the photoconductive drum 11.

From the aforementioned test results, toners having compressibility in the range of 35 to 55% are difficult to flip through the gaps between the cleaning blade 19 and the photoconductive drum 11.

Second Embodiment

FIGS. 4–8 illustrate the evaluation of cleaning effect according to a second embodiment.

The toners 16 were tested on an image forming apparatus having the same configuration as the first embodiment. The toners used in the second embodiment are those that did not flip through the gaps between the cleaning blade 19 and the photoconductive drum 11 in the first embodiment. The cleaning blade 19 extends in a direction parallel to a rotational axis of the photoconductive drum 11. The cleaning blade 19 according to the second embodiment was a resilient body having resilience in the range of 5 to 50%. During the evaluation, the cleaning blade 19 is pressed against the surface of the photoconductive drum 11 under a line pressure in the range of 1 to 10 gf/mm.

FIGS. 4–8 illustrate cleaning effect of the cleaning blade 19 when the cleaning blade 19 is pressed against the surface of the photoconductive drum 11 under a specific pressure. The toner shaving compressibility in the range of 35 to 55 were tested for different values of resilience of the cleaning blade 19 and different values of line pressure. The resilience of the cleaning blade 19 ranges from 5 to 50% and the values of line pressure are 1, 3, 5, 8, and 10 gf/mm.

Referring to FIGS. 4–8, symbol "◎" denotes that the toner particles do not flip through, and the symbol "○" indicates that poor cleaning does not damage images. In other words, the symbol "○" indicates that toner particles in areas except an image area flip through or that toners flip through over a distance of 0.5 mm or shorter along the cleaning blade but the image is not practically damaged. The symbol "X" indicates that images are damaged by poor cleaning.

It is to be noted that even if the particles of toner 16 have a shape that is not likely to form a most packed structure, if the toner is used continuously for a long time, the toner may eventually form a most packed structure. However, adjusting the resiliency of the cleaning blade 19 and the pressure applied by the cleaning blade against the photoconductive drum 11 will avoid poor cleaning results.

If the resilience of the cleaning blade 19 is small, then the toner gathered in a most packed structure at the edge of the cleaning blade 19 overcomes the resilience of the cleaning blade 19 to flip through the gaps between the cleaning blade 19 and the photoconductive drum 11.

Conversely, if the resilience of the cleaning blade 19 is large, then the edge of the cleaning blade 19 can be chipped or worn out and the toner particles flip through the chipped portions or worn out portions.

If the cleaning blade 19 presses against the photoconductive drum 11 with too small a pressure, such a small pressure cannot overcome the force that the most packed structure of toner pushes up the edge of the cleaning blade 19. As a result, the toner particles flip through the gaps between the cleaning blade 19 and the photoconductive drum 11.

If the cleaning blade 19 presses against the photoconductive drum 11 with too large a pressure, such a large pressure causes chipping and wear-out of the edge of the cleaning blade 19. As a result, the toner particles flip through the gaps between the chipped portions or worn out portions of the cleaning blade 19 and the photoconductive drum 11.

The flipping through of toner can be prevented and cleaning is improved by a combination of the toner 16 and the cleaning blade 19 that fulfil the following conditions. That is, the toner has compressibility in the range of 35 to 55% and the cleaning blade has resilience in the range of 15 to 40% and is pressed against the photoconductive drum under a line pressure in the range of 3 to 8 gf/mm. Preferably, toner 16 has compressibility in the range of 35 to 55% and the cleaning blade has resilience in the range of 20 to 35%.

The image forming apparatus according to the present invention is not limited to the aforementioned configuration but may include one in which a toner on an image bearing body is first transferred onto an intermediate transfer belt and subsequently from the intermediate transfer belt to the recording paper.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

an image bearing body that bears an electrostatic latent image formed thereon;

a developing unit that supplies a developer material to said image bearing body to develop the electrostatic latent image into a visible image;

a transfer unit that transfers the visible image onto a print medium;

a developer-removing blade in contact with said image bearing body to remove a residual amount of the developer material on said image bearing body;

wherein the developer material has substantially spherical particles and has a compressibility in the range of 30 to 55, the compressibility being given by $$A=\{(D1-D2)/D1\}\times 100(\%)$$

where A is compressibility, D1 is aerated bulk density, and D2 is packed bulk density.

2. The image forming apparatus according to claim 1, wherein said developer-removing blade has a longitudinally extending edge in contact with said image bearing body.

3. The image forming apparatus according to claim 1, wherein said developer-removing blade has a resilience in the range of 15 to 40% and is in contact with said image bearing body with the line pressure in the range of 3 to 8 gf/mm.

4. The image forming apparatus according to claim 1, wherein said developer-removing blade has a resilience in the range of 20 to 35% and is in contact with said image baring body with a line pressure in the range of 3 to 8 gf/mm.

* * * * *

UNITED STATES PATENT AND TRADEMARK OFFICE

CERTIFICATE OF CORRECTION

PATENT NO. : 6,879,798 B2
APPLICATION NO. :10/634517
DATED : April 12, 2005
INVENTOR(S) : Masamichi Aoki It is certified that error appears in the above-identified patent and that said Letters Patent is hereby corrected as shown below:

Title page, item (57) in the Abstract, penultimate line: "A={(D1-D2)/D1}x100%" should read --A={ (D2-D1)/D1}x100--;

At column 1, line 57: "A={(D1-D2)/D1}x100" should read --A={ (D2-D1)/D1}x100--;

At column 8, line 36: "35 to 55%" should read --35 to 55--;

At column 9, line 37: "fulfil" should read --fulfill--;

At column 9, lines 38 and 39: "35 to 55%" should read --35 to 55--;

At column 9, lines 42 and 43: "35 to 55%" should read --35 to 55--;

At column 10, line 28: "A={(D1-D2)/D1}x100%" should read --A={ (D2-D1)/D1}x100--;

At column 10, line 39, "the" should be replaced with --a--;

In the drawings: please replace drawing sheets 3/5, 4/5 and 5/5 with the attached replacement sheets 3/5, 4/5 and 5/5.

Signed and Sealed this

Nineteenth Day of February, 2008

JON W. DUDAS
*Director of the United States Patent and Trademark Office*

FIG.4

| RESILIENCE % | COMPRESSIBILITY | | | | |
|---|---|---|---|---|---|
| | 55 | 50 | 45 | 40 | 35 |
| 50 | × | × | × | × | × |
| 40 | × | × | × | × | × |
| 35 | × | × | × | × | × |
| 30 | × | × | × | × | × |
| 25 | × | × | × | × | × |
| 20 | × | × | × | × | × |
| 15 | × | × | × | × | × |
| 10 | × | × | × | × | × |
| 5 | × | × | × | × | × |

FIG.5

| RESILIENCE % | COMPRESSIBILITY | | | | |
|---|---|---|---|---|---|
| | 55 | 50 | 45 | 40 | 35 |
| 50 | × | × | × | × | × |
| 40 | ○ | ○ | ○ | ○ | ○ |
| 35 | ◎ | ◎ | ◎ | ◎ | ◎ |
| 30 | ◎ | ◎ | ◎ | ◎ | ◎ |
| 25 | ◎ | ◎ | ◎ | ◎ | ◎ |
| 20 | ◎ | ◎ | ◎ | ◎ | ◎ |
| 15 | ○ | ○ | ○ | ○ | ○ |
| 10 | × | × | × | × | × |
| 5 | × | × | × | × | × |

FIG.6

| RESILIENCE % | COMPRESSIBILITY | | | | |
|---|---|---|---|---|---|
| | 55 | 50 | 45 | 40 | 35 |
| 50 | × | × | × | × | × |
| 40 | ○ | ○ | ○ | ○ | ○ |
| 35 | ◎ | ◎ | ◎ | ◎ | ◎ |
| 30 | ◎ | ◎ | ◎ | ◎ | ◎ |
| 25 | ◎ | ◎ | ◎ | ◎ | ◎ |
| 20 | ◎ | ◎ | ◎ | ◎ | ◎ |
| 15 | ○ | ○ | ○ | ○ | ○ |
| 10 | × | × | × | × | × |
| 5 | × | × | × | × | × |

FIG.7

| RESILIENCE % | COMPRESSIBILITY | | | | |
|---|---|---|---|---|---|
| | 55 | 50 | 45 | 40 | 35 |
| 50 | × | × | × | × | × |
| 40 | ○ | ○ | ○ | ○ | ○ |
| 35 | ◎ | ◎ | ◎ | ◎ | ◎ |
| 30 | ◎ | ◎ | ◎ | ◎ | ◎ |
| 25 | ◎ | ◎ | ◎ | ◎ | ◎ |
| 20 | ◎ | ◎ | ◎ | ◎ | ◎ |
| 15 | ○ | ○ | ○ | ○ | ○ |
| 10 | × | × | × | × | × |
| 5 | × | × | × | × | × |

FIG.8

| RESILIENCE % | COMPRESSIBILITY | | | | |
|---|---|---|---|---|---|
| | 55 | 50 | 45 | 40 | 35 |
| 50 | × | × | × | × | × |
| 40 | × | × | × | × | × |
| 35 | × | × | × | × | × |
| 30 | × | × | × | × | × |
| 25 | × | × | × | × | × |
| 20 | × | × | × | × | × |
| 15 | × | × | × | × | × |
| 10 | × | × | × | × | × |
| 5 | × | × | × | × | × |